US005721458A

United States Patent [19]

Kearney et al.

[11] Patent Number: 5,721,458

[45] Date of Patent: Feb. 24, 1998

[54] SINGLE PHASE OR THREE-PHASE FIELD CONFIGURABLE POWER ASSEMBLY

[75] Inventors: Daniel James Kearney, Port Ewen; Steven John Ahladas, Highland; David Nicholas Ayd, Mt. Tremper, all of N.Y.

[73] Assignee: International Business Machines Corporation, Armonk, N.Y.

[21] Appl. No.: 414,068

[22] Filed: Mar. 31, 1995

[51] Int. Cl.[6] ..... G08C 19/00

[52] U.S. Cl. ..... 307/150; 395/280; 395/283; 395/200.02; 395/750; 364/492; 364/273.5; 364/948.91; 364/948.4; 340/825.54

[58] Field of Search ..... 307/43, 44, 45, 307/80, 85, 86, 149, 150, 151, 115, 125; 361/724, 727, 726–730, 695; 340/825.07, 825.52, 825.54, 825; 364/492, 273.5, 948.4, 948.91; 395/283, 311, 750, 200.02, 280; 363/148, 151

[56] References Cited

U.S. PATENT DOCUMENTS

| | | | |
|---|---|---|---|
| 4,613,861 | 9/1986 | Ault | 340/825.52 |
| 4,899,254 | 2/1990 | Ferchau et al. | 361/695 |
| 4,922,449 | 5/1990 | Donaldson et al. | 364/900 |
| 5,077,684 | 12/1991 | Kitajima | 340/825.52 |
| 5,121,500 | 6/1992 | Arlington et al. | 395/750 |
| 5,293,636 | 3/1994 | Bunton et al. | 364/948.4 |
| 5,297,261 | 3/1994 | Kuranaga | 364/273.5 |
| 5,526,493 | 6/1996 | Shu | 395/283 |
| 5,530,302 | 6/1996 | Hamre et al. | 307/147 |
| 5,568,617 | 10/1996 | Kametani | 395/280 |
| 5,572,685 | 11/1996 | Fisher et al. | 395/287 |
| 5,591,984 | 1/1997 | Drudrer | 364/941.91 |
| 5,617,547 | 4/1997 | Feeney et al. | 395/311 |
| 5,625,780 | 4/1997 | Hsieh et al. | 395/311 |

*Primary Examiner*—William M. Shoop, Jr.
*Assistant Examiner*—Peter Ganjian
*Attorney, Agent, or Firm*—Lawrence D. Cutter

[57] ABSTRACT

The capability of base power units which have phase switching capabilities which can be controlled upon sensing the power condition and status of other base power units is taken advantage of to provide a modular scalable power assembly. The base power units, which are preferably identical, are inserted into a plurality of slots so as to be pluggable into a circuit backplane which automatically provides the requisite interconnections between the base power units. The power assembly of the present invention is particularly useful in supplying power to scalable parallel processing computer systems.

5 Claims, 8 Drawing Sheets

SINGLE PHASE OR THREE-PHASE FIELD CONFIGURABLE POWER ASSEMBLY

The present invention is generally directed to a power assembly which is particularly useful in scalable parallel processing computer systems. More particularly, the present invention is directed to a power assembly which receives single or three-phase AC input power and which supplies DC power output to one or more pieces of electronic equipment. In particular, the present invention provides a system for power scalability in which identical base power units may be plugged into a chassis backplane which includes position-sensitive slots.

The present invention has been motivated by the need to provide scalable power for parallel processing computer systems. The scalability of a power supply is an extremely desirable aspect of such systems. Such systems may include a small or large plurality of computer processing nodes each of which is capable of consuming a certain amount of electrical power. However, purchasers of such systems may, in fact, purchase a system with only a single node. However, the intention of such customers and other customers is almost always to expand these systems as their information processing requirements increase. In particular, it is seen that this expandability is particularly desirable in the parallel processing field. In this field, the computing processing power is scalable in that additional processors may be added as needed. This causes a concomitant increase in the need for additional electrical power.

It is therefore very desirable to be able to upgrade a customer's computer system in terms of its power requirements in an easy, convenient, intuitive, safe, error free and convenient manner. In particular, it is desirable to provide a field upgradable power supply which is as simple as possible to install. In particular, it is desirable to avoid power switches which must be correctly positioned subsequent to installation of units with a higher or different power rating. In certain systems, the requirements for manual switch operation may result in power supply failure if the human factor concerns which occur during upgrade are not addressed. In such circumstances, failing to position switches in a proper time sequence may result in power system failure and/or damage.

Additionally, it is noted that customers for computer processors whose physical installation requirements may be limited in terms of power often desire a single phase power input option for low power entry models of a computer system. Nonetheless, these same customers desire that the power supply unit be field upgradable to higher power models requiring three-phase AC power input. It should also be appreciated that there are times when it is necessary or desirable to downgrade power requirements as, for example, when a rack of equipment is depopulated during a reconfiguration in which power sinks are redistributed over several racks.

Another requirement that computer processing installations possess is the need for high availability of their processing units. Accordingly, power supply assemblies and/or systems should be compatible with mechanisms that assure some form of redundancy in the event of power supply unit failure.

There are, in addition, other requirements that are desirable in power supplies. In particular, it is seen that a power supply, particularly one for a computer system, be adaptable to voltage conditions as they exist in many different national jurisdictions. Accordingly, it is desirable that the power supply system work at both 50 and 60 Hz power input frequencies and within one or more voltage ranges.

Additionally, it is noted that it is desirable that the design of the power supply assembly be such that identical modular units be employed. This design capability permits the issuance of a single part number. Since maintenance of different part numbers can be a significant, albeit unappreciated, economic overhead it is seen that the single part number feature is a desirable aspect of any modular power supply system.

Briefly, it can be stated that the problem solved by the present invention is the creation of a power supply assembly that is easily field configurable for low power, single phase operation or for high power, three-phase operation without risk of human induced configuration failures.

SUMMARY OF THE INVENTION

In accordance with a preferred embodiment of the present invention, a scalable electric power assembly comprises a chassis which is capable of receiving a plurality of base power units which are mountable in a plurality of chassis positions. There is also provided means for sensing the power condition associated with at least one base power unit connected to the chassis. There is also provided means for selectively activating the base power units based upon the sensed power condition and also based upon base power unit position in the chassis. The power assembly also preferably includes means for selectively activating the base power unit based upon the number of units connected to the chassis.

In a preferred embodiment of the present invention, a slotted chassis with a specific backplane interconnection configuration is provided which is capable of interconnecting base power units. In one exemplary embodiment of the present invention, a power supply assembly includes four slots. Two of these slots are configured with line sharing means which operates to provide redundancy. These two slots are special in that they accept base power units which are inserted into the slots, and, as a result of the insertion, provide line sharing interconnections between two base power units when these units are present in a special slot pair. In a preferred embodiment of the present invention for parallel processing computer systems, certain slots are wired to the chassis backplane so as to provide line share communications with a co-resident redundant base power unit. However, the design of the present invention is logically expandable to provide line sharing capability for other base power pairs.

The chassis backplane interconnections are such that identical base power units are insertible therein and the insertion automatically configures the power supply assembly so that there is no need for human intervention. If base power units are inserted into incorrect slots, the unit inserted does not function, but, on the other hand, it does not malfunction either.

Accordingly, it is an object of the present invention to provide a power supply assembly which is capable of scalable configurations.

It is also an object of the present invention to provide a modular power supply in which each module is identical and which therefore possesses the same part number.

It is a further object of the present invention to provide a scalable electrical power assembly for parallel processing computer systems.

It is yet another object of the present invention to provide a scalable electrical power assembly for any piece of electronic equipment which, for whatever reason, requires more or less electrical power.

It is also an object of the present invention to provide a field configurable power supply.

It is yet another object of the present invention to provide a power supply assembly which is not prone to human error during equipment reconfiguration to a different (higher or lower) power level.

It is also an object of the present invention to provide a power supply having a plurality of slots into which modular units may be easily inserted, especially to effect a field upgrade.

It is yet another object of the present invention to provide a power supply assembly in which insertion of upgrade modular units may be position sensitive, especially in those cases where line sharing redundancy is provided.

It is also an object of the present invention to provide a power supply assembly which exhibits so-called N+1 redundancy.

It is also an object of the present invention to provide a power supply which does not necessarily require a neutral connection.

It is yet another object of the present invention to provide a power supply assembly whose output power is incrementable and which possesses phase switching capabilities.

Lastly, but not limited hereto, it is an object of the present invention to simplify the upgrading of power supplies in the field, especially power supplies used in parallel processing computer systems.

DESCRIPTION OF THE DRAWINGS

The invention, both as to organization and method of practice, together with the further objects and advantages thereof, may best be understood by reference to the following description taken in connection with the accompanying drawings in which.

DETAILED DESCRIPTION OF THE INVENTION

Figure 1:
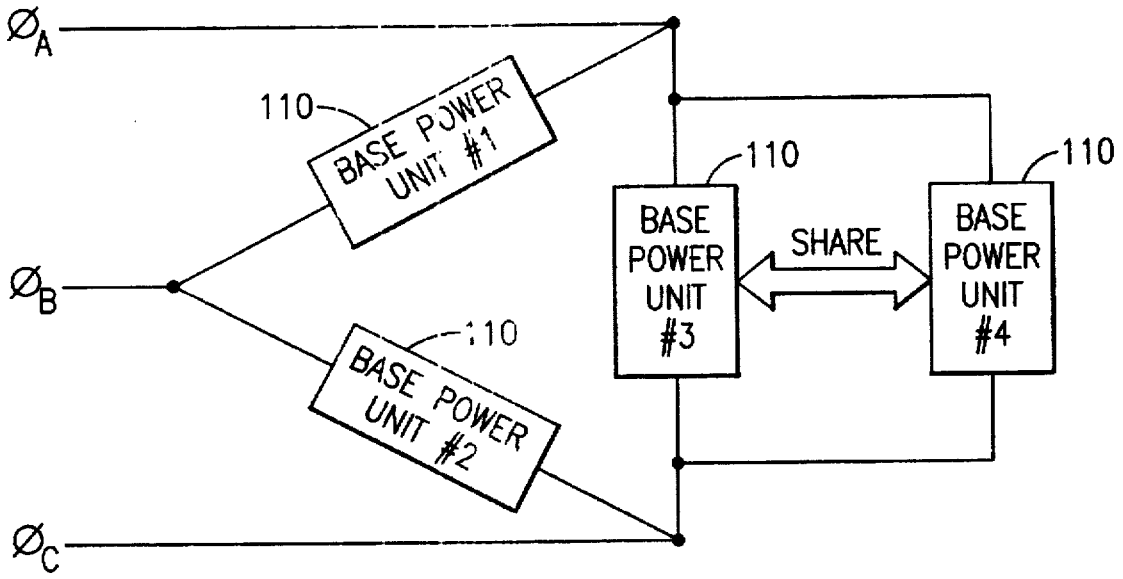
FIG. 1 is an electrical circuit block diagram illustrating the overall connection of a unit incorporating four base power units (BPUs) in a delta configuration with line share redundancy.

FIG. 1 illustrates identical base power units 1, 2 and 3 (reference numerals 110) configured in a delta arrangement receiving three-phase power. These phases are designated A, B and C, as is conventional. Additionally, it is noted that base power units 3 and 4 are connected in parallel and are additionally connected together by a pair of line sharing signals. The concept and operation of line sharing is more particularly described below. It is noted that line sharing provides a mechanism for N+1 redundancy which is provided at the same time as three-phase line balancing. Electrical circuits which perform the line sharing function are more particularly illustrated in FIG. 5 which is discussed below. While FIG. 1 illustrates a situation in which four base power units are employed, it is noted that it is also possible that other ones of the base power units may also include line sharing capabilities. However, for the purposes of the present invention which include powering a scalable parallel processing computer system, the preferred embodiment is shown in FIG. 1.

FIG. 1 is meant to illustrate the overall connection of the base power units under normal operating circumstances. However, it is contemplated herein, that each of the base power units includes a mechanism to effect phase switching. Accordingly, in practice all three phases are supplied to each of the base power units. However, in normal operation, the base power units are connected as shown in FIG. 1 and operate to produce DC electrical power.

Figure 2:
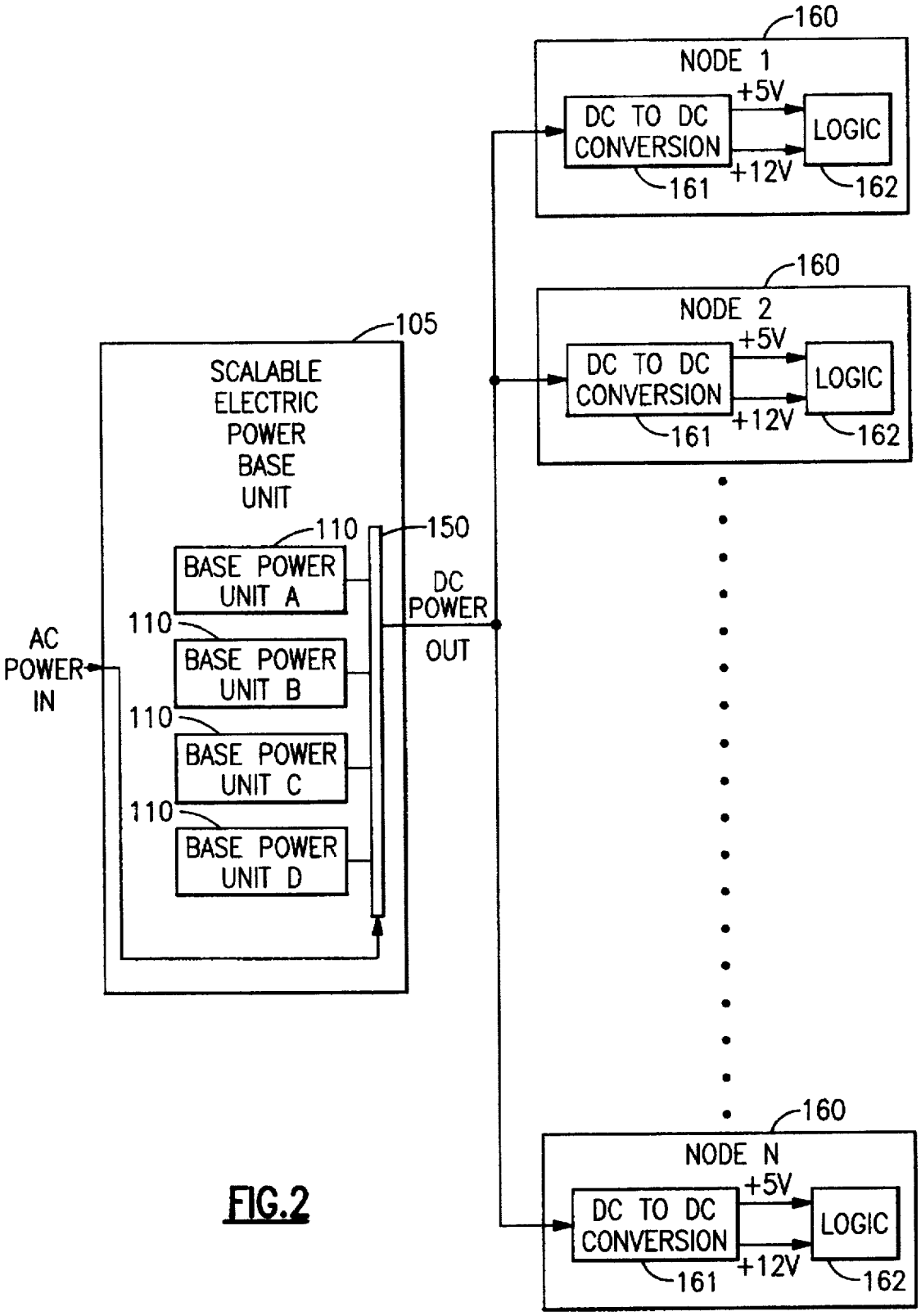
FIG. 2 is an electrical circuit block diagram illustrating the embodiment in which the present invention may be employed to power multiple nodes in a scalable parallel processing computer system.
Figure 3:
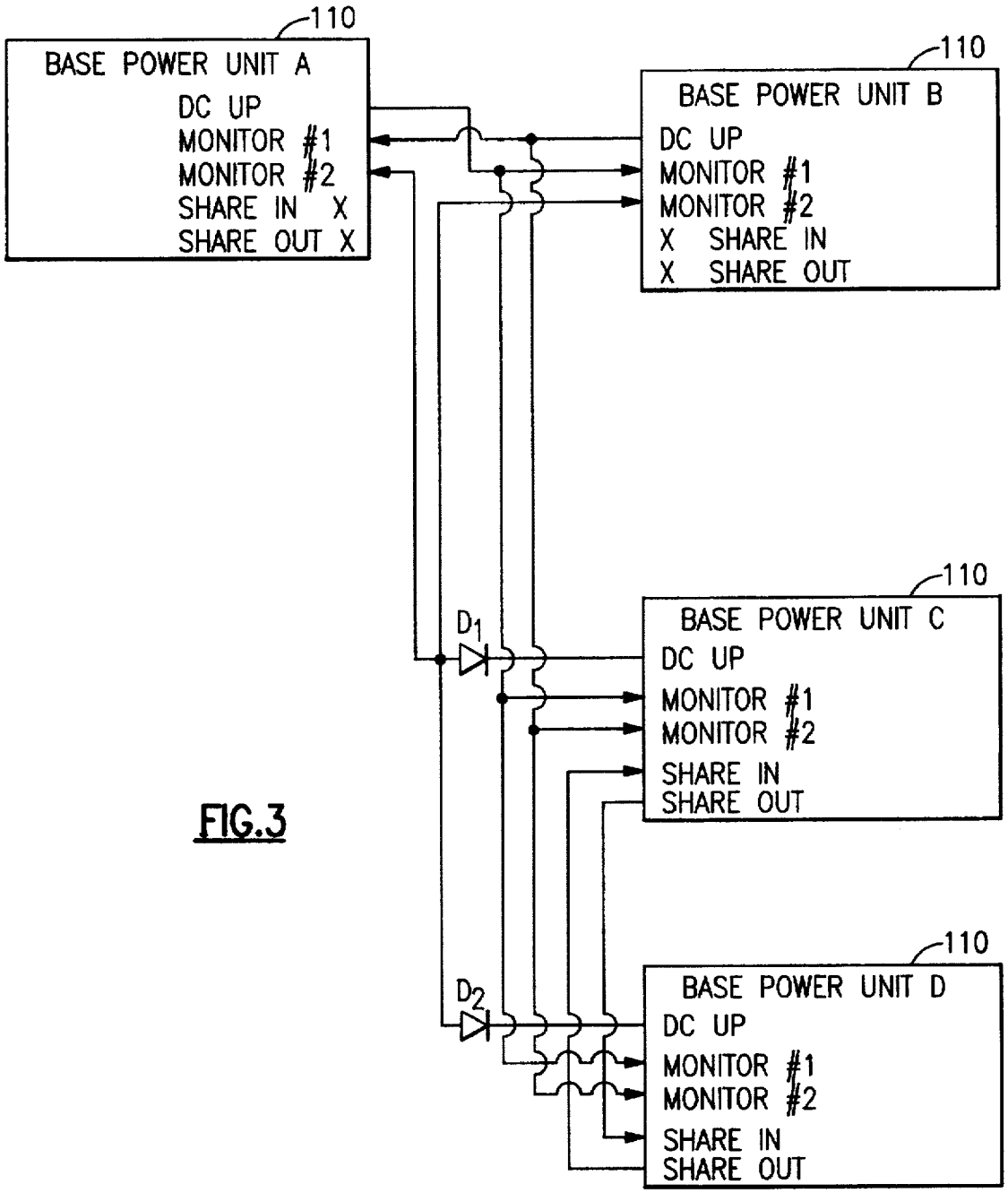
FIG. 3 is an electrical circuit block diagram illustrating the interconnections which are made when base power units A through D are inserted into a four-slot backplane chassis.

FIG. 2 illustrates in more detail the environment in which the scalable electrical power supply 105 of the present invention is employed. In particular, supply 105 includes base power units 110, more particularly designated as units A, B, C and D, which are insertible into chassis backplane 150. In preferred embodiments of the present invention, the connections between base power unit 110 and chassis backplane 150 are simply rendered by sliding the units into designated slots in the housing for supply 105. When fully inserted, plugs at the back of base power units 110 engage corresponding sockets on backplane 150. It is through the connection patterns provided on backplane 150 that base power units A through D receive AC power as an input and provide DC power as an output to a plurality of computer nodes 160, and it is also through these connective patterns that phase switching and line sharing signal connections are made as shown in FIG. 3. Each of the nodes shown typically includes its own DC-to-DC conversion unit 161 which supplies logic unit 162 with desired levels of DC voltage, say, for example, 5 volts and 12 volts. The general N node arrangement is shown in FIG. 2.

Figure 7:
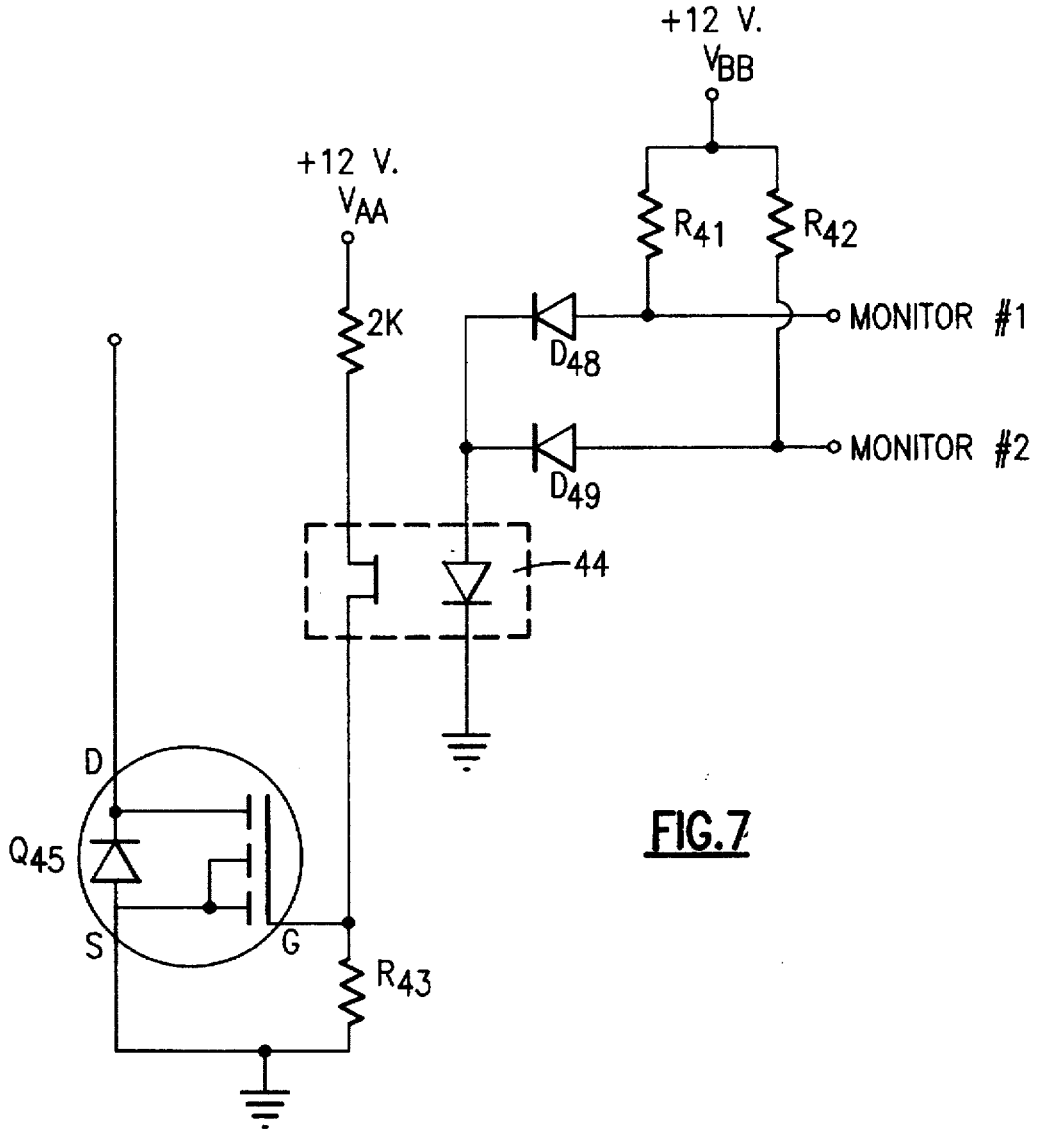
FIG. 7 is an electrical circuit diagram detailing the structure and function of the monitor ports in the base power units.
Figure 8:
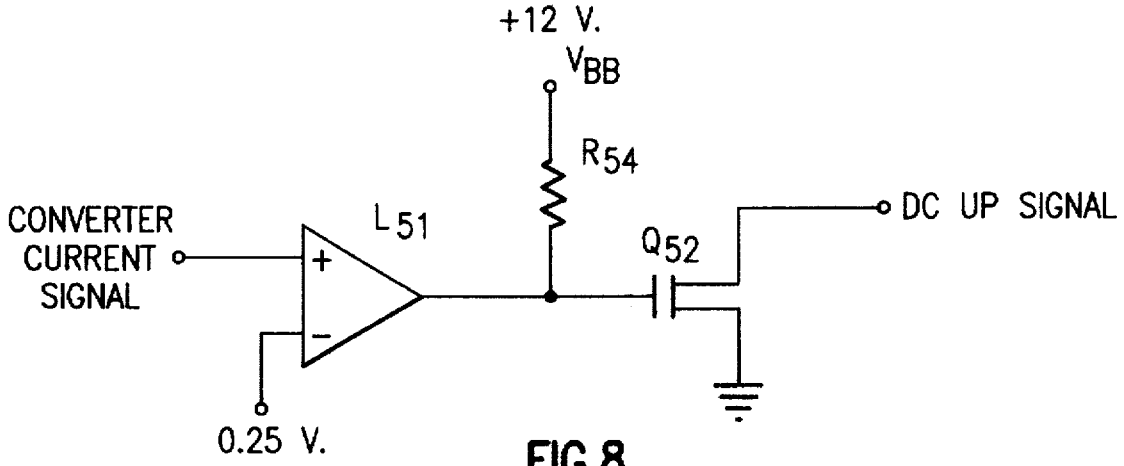
FIG. 8 is an electrical circuit diagram illustrating a preferred mechanism for providing a signal indicating that a converter unit is functioning appropriately.
Figure 9:
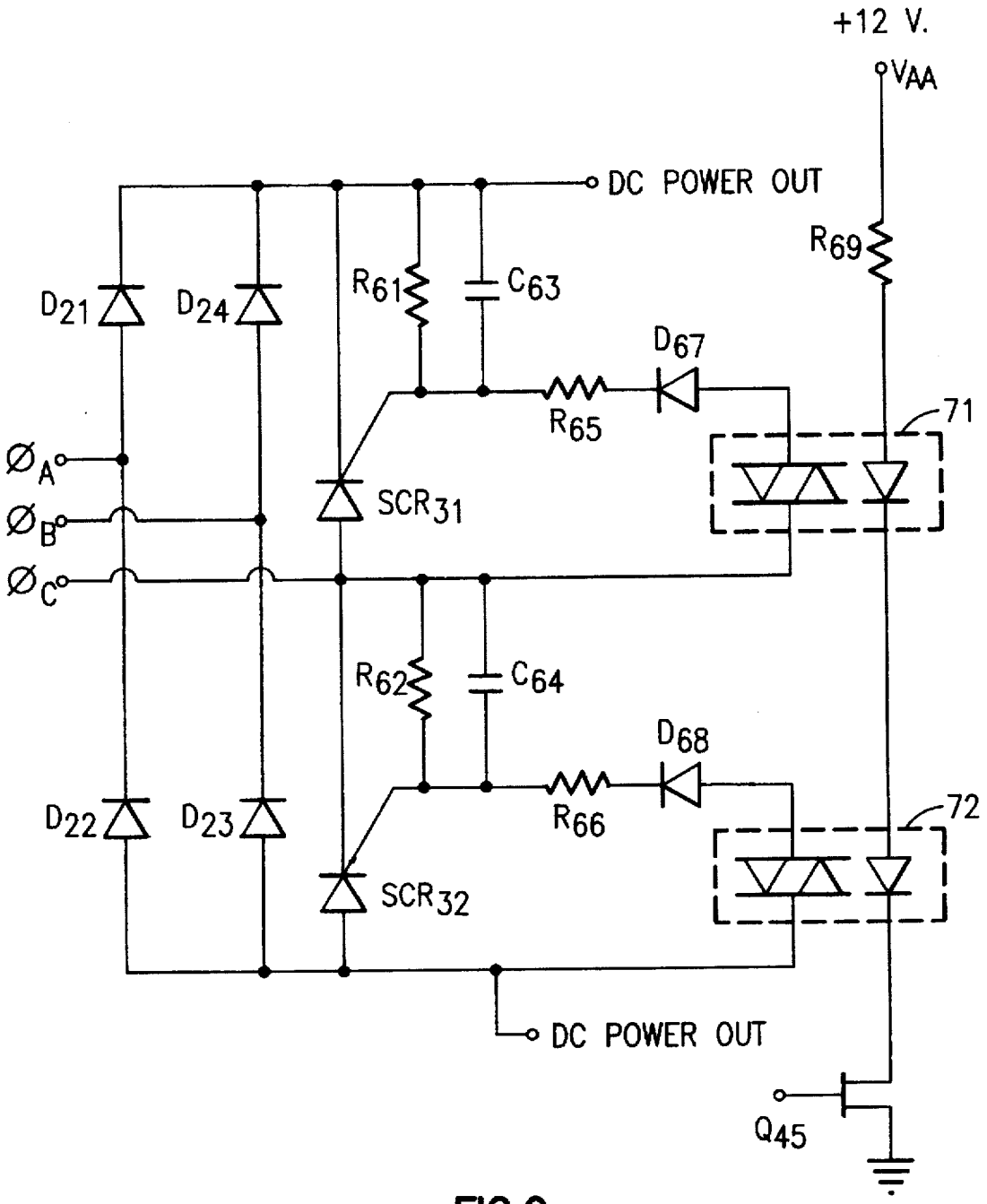
FIG. 9 is an electrical circuit diagram illustrating the connection between a pair of opto-isolators and another opto-isolator employed in a monitor path feedback path to control phase switching.

When base power units 110 are inserted into backplane 150, the circuit patterns on chassis backplane 150 interconnect the base power units as shown in FIG. 3. In particular, it is noted that in an exemplary embodiment of the present invention, slots C and D, which receive corresponding base power units C and D, are unique in that line sharing connections (SHARE IN and SHARE OUT) are made between base power unit C and slot C and base power unit D and slot D as shown in FIG. 3. More fundamentally however, it is noted that each base power unit 110 includes a means for supplying a "DC UP" signal indicating that the power unit is supplying a sufficient amount of current for it to be considered functional. For each unit the "DC UP" signal is preferably supplied to all of the other base power units. However, with respect to the "DC UP" signals emanating from the base power units in slots C and D, these signals are supplied through diodes $D_1$ and $D_2$, as shown. Likewise, it is seen from FIG. 3 that each of the base power units includes monitor ports 1 and 2 for sensing the functionality status for other ones of the base power units. In the event that one of the other units is not functioning, phase switching circuitry is activated which causes the base power unit to switch its phase dependency from, say, phases A and B to "dependency" on phases B and C. The circuits for accomplishing the phase switching are more particularly illustrated in FIGS. 6 and 9. The circuits which effectively implement the monitoring ports are shown in FIGS. 7 and 9; and the circuit which provides the "DC UP" signal is particularly shown in FIG. 8. However, FIG. 3 is important for its role in providing a description of the interconnections that exist between the base power units when they are inserted into the various slots in the power supply unit cabinet.

Figure 4:
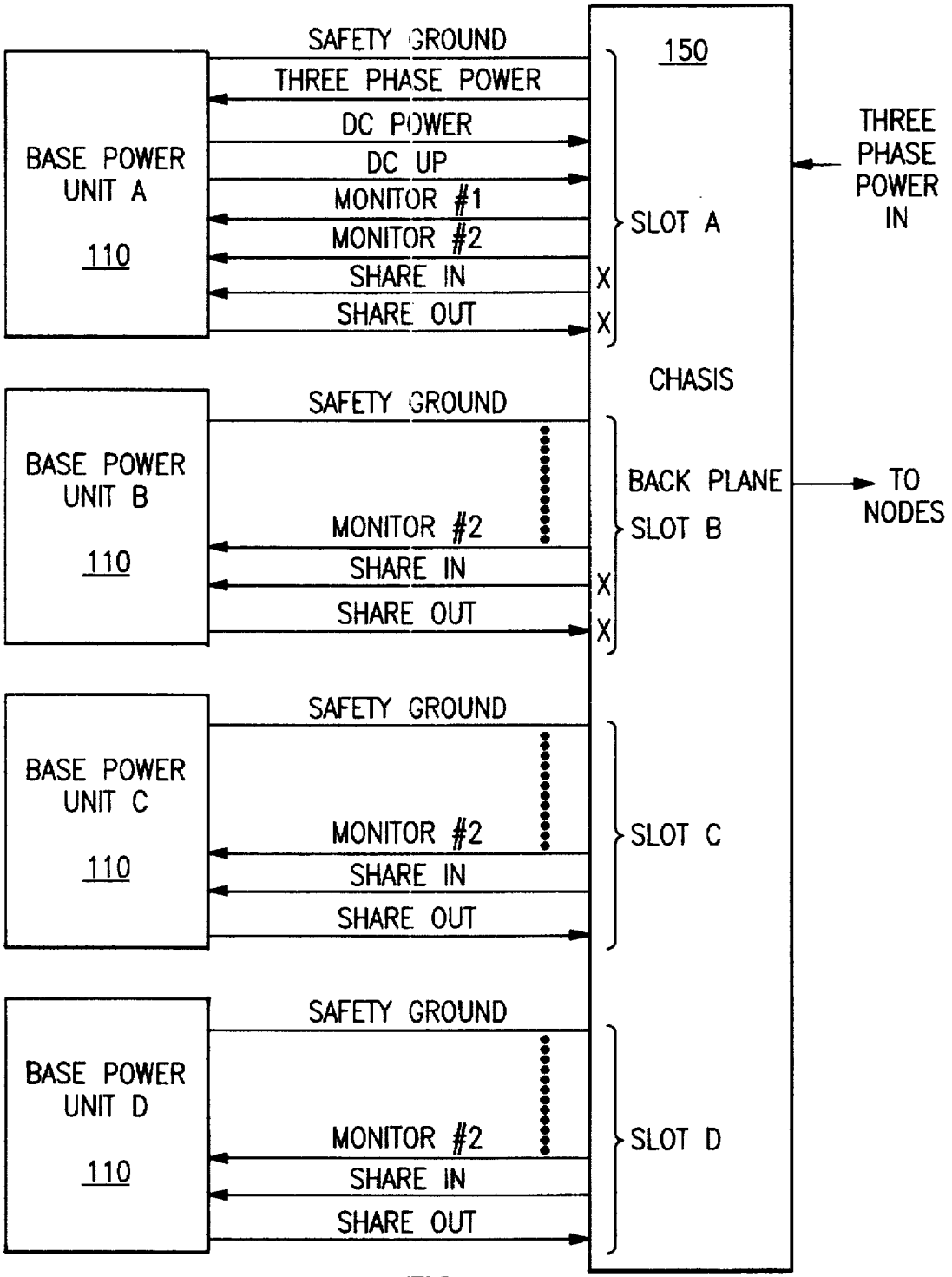
FIG. 4 is a block diagram illustrating the connections that exist between the base power units and the chassis backplane and which more particularly illustrate the point that line sharing, in the example shown, is absent except in slots C and D.

FIG. 4 provides a more detailed description of the connections that are made when a base power unit is inserted into one of the slots in chassis backplane 150. In particular, in the case of base power unit A (reference numeral 110) it is seen that a safety ground links the base power unit with the ground on chassis backplane 150. Additionally, as noted above, chassis backplane 150 provides the interconnection mechanism for supplying multiple phase power connections for base power unit A. Reciprocally, DC power is also supplied to processing nodes 160 from the base power units through chassis backplane 150. Backplane 150 also provides a connection from other "DC UP" connections to monitor ports 1 and 2. Additionally, it is noted that insertion of base power units into the chassis backplane provides connections (in slots C and D only in this implementation) between the SHARE IN and SHARE OUT circuits. While these circuits may be present in base power units A and B, they are not activated (in this exemplary embodiment) by insertion into backplane 150. The object of inserting the base power units into the slots is to achieve, in general, for the purposes stated herein, the configuration illustrated in FIGS. 1 and 3. As such, even though line share circuitry may be present in base power units A and B, the lack of connection support via chassis backplane 150 does not enable such circuitry. Thus, even though this is somewhat wasteful of line share circuitry for base power units A and B, nonetheless complete and full interchangability of the power units is still nonetheless present and desired for all of the reasons indicated above with respect to the stated objects herein.

Figure 5:
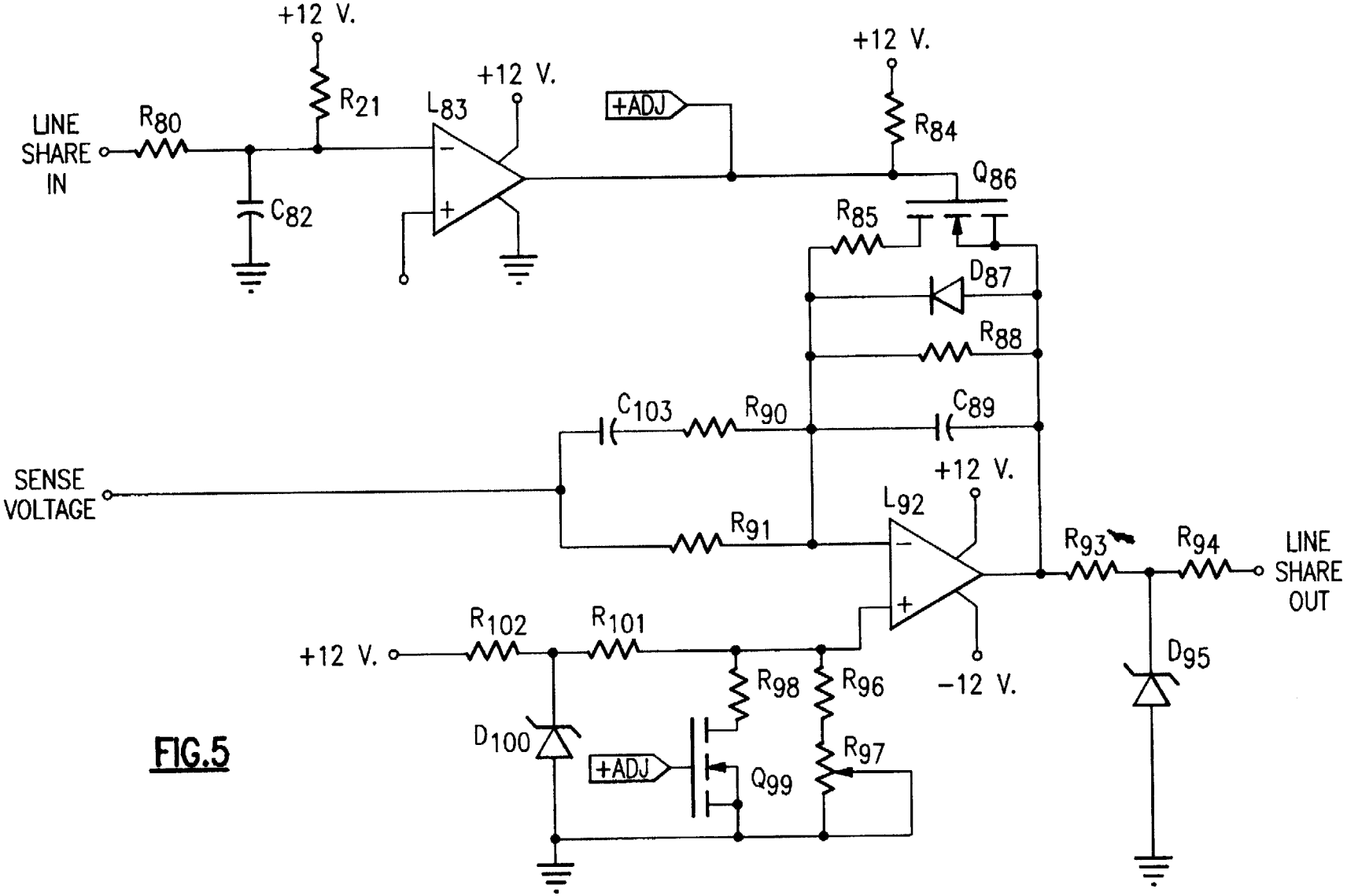
FIG. 5 is an electrical circuit diagram illustrating line sharing circuitry.

In FIG. 5 it is seen that the SHARE IN signal is supplied to resistor $R_{80}$ which, together with capacitor $C_{82}$, provides low pass filtering action for the signal. Resistor $R_{21}$ is provided as a pull-up resistor. Comparator $L_{83}$ is used to perform an inversion function.

As part of the regulator feedback loop, a sensed voltage signal is provided to capacitor $C_{103}$ and resistor $R_{91}$ connected as shown. The SENSE VOLTAGE supplied to the circuit of FIG. 5 is a rescaled output voltage, scaled to a power voltage for use in the control circuit.

The components associated with $Q_{86}$ form the "error amplifier" for the base power supply units. This is the heart of the regulation control since it makes the required adjustments to achieve regulation. $Q_{86}$ switches in resistor $R_{85}$ via signals on the +ADJ line thus reducing the gain of the error amplifier thus causing the desired change in the regulator current voltage characteristic. The modification of this characteristic on the shared phase forces the two base power units operating in parallel to have the same current-voltage regulator slope characteristic as that of a single converter operating normally. The regulation slope is thus adjusted by changing the DC gain of the voltage error amplifier ($Q_{86}$ and its associated components). In current mode, control of the output of the voltage error amplifier causes a proportional output regulator current. Thus, the gain of the voltage error amplifier determines the slope of the regulation characteristic.

Converters with a regulation slope are type 0 systems (no error integration). As a result, they have a finite error that is inversely proportional to the DC loop gain (for high gain systems). Since the loop gain has been changed to adjust the regulation slope, compensation should also be made for the error term. This is achieved by adjusting the reference voltage of the error amplifier.

The regulation slope is adjusted by switching in resistors $R_{85}$ and $R_{98}$. Resistor $R_{85}$ controls the regulation slope, since it controls the gain of the voltage error amplifier, as described above. Resistor $R_{98}$ controls the "hit" or nominal output voltage of the regulator. Resistor $R_{98}$ corrects for the error term due to a change in the feedback of the error signal due to the switching in of resistor $R_{85}$. Resistor $R_{98}$ is switched in by transistor $Q_{99}$ so as to change the set point to which the error amplifier is regulating. The output of the error amplifier is provided to the power stage to increase or decrease output voltage.

Each of base power units 110 includes a circuit for providing a signal which indicates that the proper current is being supplied by the converter unit. For the situation in which there are four converter units, as shown in FIG. 3, it is seen that the "DC UP" signal is supplied to each of the other base power units. The connections for these signals are shown in FIG. 3. The base power units in FIG. 3 are preferably connected in the delta configuration as shown in FIG. 1. However, for purposes of clarity, this connection arrangement is not specifically illustrated in FIG. 3.

Figure 6:
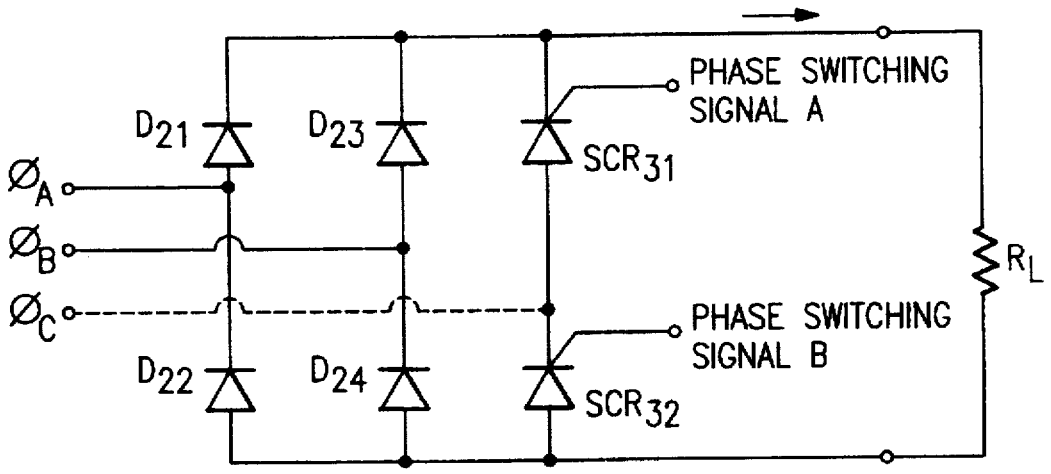
FIG. 6 is an electrical circuit schematic diagram illustrating a typical bridge circuit switching converter in accordance with the present invention.

FIG. 6 illustrates a converter unit and equivalent load R which is effectively seen by each of the base power units 110 when operating. FIG. 6 also particularly illustrates the utilization of two silicon control rectifier devices $SCR_{31}$ and $SCR_{32}$ to provide desired phase switching capability. In normal operation, diodes $D_{21}$, $D_{22}$, $D_{23}$ and $D_{24}$ provide a full wave rectifier which converts the power phases A and B to a DC current across the load. However, in the event that one of the phases fail, the converter is also supplied with a third phase which supplies current to the node that exists between silicon control rectifiers $SCR_{31}$ and $SCR_{32}$. Thus, phase switching is accomplished through the utilization of these two SCR devices. To see how control of these gates is effected by means of signals supplied to their gates, see FIG. 9.

In the present invention, each base power unit 110 has included therein a bridge converter unit such as illustrated in FIG. 6. Each base power unit 110 also includes means for monitoring other ones of the base power units (which include not only the converters shown but also regulators). It is however noted that, for purposes of isolation in electrical power supply systems, opto-electrical isolators such as unit 44 in FIG. 7 are provided. In particular, resistors $R_{41}$ and $R_{42}$ together with diodes $D_{48}$ and $D_{49}$ as shown in FIG. 7 form a two-input OR gate which is powered from bias supply voltage $V_{BB}$, preferably 12 volts. When either of the signals on monitor line #1 or #2 are "UP", the light source in opto-electrical isolator 44 is energized to trigger the corresponding transistor in the isolator unit. This provides desirable electrical isolation. In effect, when a signal is present on either monitor #1 line or monitor #2 line, the switch in the secondary portion of opto-isolator 44 is closed thus resulting in an increased voltage drop across resistor $R_{43}$ from biased voltage source $V_{AA}$, thus producing a voltage at the gate of transistor $Q_{45}$. Transistor $Q_{45}$, as shown in FIG. 7, is depicted as an FET device. However, it is also possible to employ a bipolar transistor in this role. The functioning of transistor $Q_{45}$ is, however, more particularly described below in the discussion referencing FIG. 9. However, suffice to say here, that the signals present on monitor lines #1 or #2 are employed to trigger the gate signal lines for $SCR_{31}$ and $SCR_{32}$.

The signals appearing on monitor lines #1 and #2 are derived from circuits present in base power units 110. In particular, such a circuit is shown in FIG. 8. It is seen therein that a converter current signal is supplied to comparator $L_{51}$ which also receives a one quarter volt bias line. In particular, the converter current signal preferably ranges in value from zero volts to approximately four volts thus indicating the current level being supplied by the respective base power units. A base power unit current signal of zero volts means that no current is being supplied, while a converter current signal level of approximately four volts preferably indicates that the converter in the base power unit is operating at a maximum current condition. The signal from comparator $L_{51}$ is supplied to the base of transistor $Q_{52}$ which also receives a bias current from voltage supply $V_{CC}$ through resistor $R_{54}$. One of the output signals from transistor $Q_{52}$, that is the one that is not attached to ground, is supplied as the "DC UP" signal (see FIG. 3).

Operating through the optical isolator shown in FIG. 7, the "DC UP" signals which are supplied to the various monitor input ports, ultimately trigger the transition of transistor $Q_{45}$ into the ON state. In this state, it draws current from voltage supply $V_{DD}$ through resistor $R_{69}$ as shown in FIG. 9. The current through resistor $R_{69}$ into the diode portions of opto-isolators 71 and 72 causes the triggering of the corresponding but isolated TRIAC devices in opto-isolators 71 and 72. This signal is provided from opto-isolator 71 through diode $D_{67}$ and resistor $R_{65}$ to the gate of $SCR_{31}$. Likewise, the same current flowing through resistor $R_{69}$ triggers a current flow through the TRIAC portion of opto-isolator 72, through diode $D_{68}$ and resistor $R_{66}$ to the gate of $SCR_{32}$. It is in this fashion that phase switching is accomplished when there is an indication that the "DC UP" signal is "not all that it should be". There is also provided in FIG. 9, resistors $R_{61}$ and $R_{62}$, which operate to provide protection against overcurrent conditions through the gates of $SCR_{31}$ and $SCR_{32}$, respectively. There is also preferably provided capacitors $C_{63}$ and $C_{64}$, as shown, in parallel with resistors $R_{61}$ and $R_{62}$ to provide noise mitigation. DC power out is as shown. It is further noted that FIGS. 9 and 7 are logically linked via transistor $Q_{45}$.

In a preferred embodiment of the present invention, the component values of the various circuit elements are as specified in Table I below.

TABLE I

| | |
|---|---|
| $R_{41}$ | 2 K |
| $R_{42}$ | 2 K |
| $R_{43}$ | 1 KΩ |
| $R_{54}$ | 10 KΩ |
| $R_{61}$ | 1 KΩ |
| $R_{62}$ | 1 KΩ |
| $R_{65}$ | 100 KΩ |
| $R_{66}$ | 100 KΩ |
| $R_{69}$ | 390 KΩ |
| $R_{80}$ | 100 KΩ |

TABLE I-continued

| | |
|---|---|
| $R_{81}$ | 10 KΩ |
| $R_{84}$ | 10 KΩ |
| $R_{85}$ | 294 KΩ |
| $R_{88}$ | 316 KΩ |
| $R_{90}$ | 2.43 KΩ |
| $R_{91}$ | 40.2 KΩ |
| $R_{93}$ | 4.99 KΩ |
| $R_{94}$ | 4.99 KΩ |
| $R_{96}$ | 29.4 KΩ |
| $R_{97}$ | 100 KΩ, 0.5 WATTS |
| $R_{98}$ | 17.4 KΩ |
| $R_{101}$ | 1 KΩ |
| $R_{102}$ | 3.01 KΩ |
| $C_{63}$ | 0.1 μf |
| $C_{64}$ | 0.1 μf |
| $C_{82}$ | 0.1 μf |
| $C_{89}$ | 68000 pf |
| $C_{91}$ | 0.022 μf |
| opto-isolator 44 | CNY-65 (Telefunken) |
| opto-isolator 71,72 | MOC-3083 (Motorola) |
| (D1,D2,D3,D4) | 35MB140A (International Rectifier) |
| ($SCR_{31}$, $SCR_{32}$) | B25DS120 (International Rectifier) |
| $Q_{45}$ | VN2222LL (Motorola) |
| $Q_{52}$ | VN2222LL (Motorola) |
| $D_{48}$ | 1N4531 (Rohm) |
| $D_{49}$ | 1N4531 (Rohm) |
| $D_{67}$ | GI-GP10V (General Instruments) |
| $D_{68}$ | GI-GP10V (General Instruments) |
| $L_{83}$ | LM339 (National Semiconductor) |
| $Q_{86}$ | VN2222LL (Motorola) |
| $Q_{99}$ | VN2222LL (Motorola) |
| $D_{87}$ | 1N4531 (Rohm) |
| $L_{92}$ | LF412A (National Semiconductor) |
| $D_{100}$ | LT1029A (Linear Technologies) |
| $D_{95}$ | 1N5523B (Motorola) |

Figure 10:
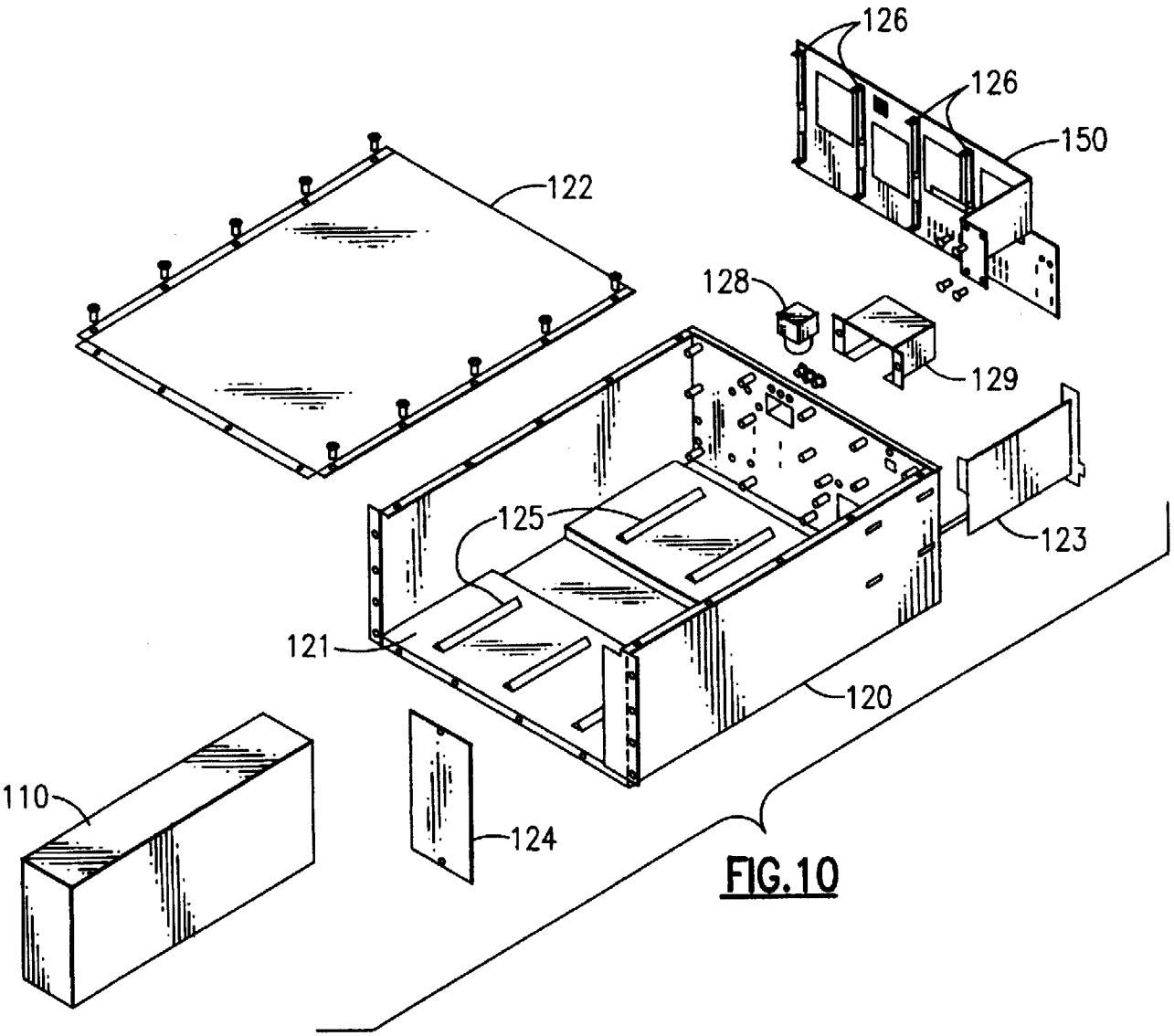
FIG. 10 is an exploded view illustrating the mechanical construction of the cabinet, slots and backplane chassis of the present invention.

In terms of the preferred mechanical construction of the present invention, this is illustrated in FIG. 10 in an exploded view. In particular, it is seen that base power unit 110 is slidable into slot 121 in housing 120 which also possesses slot guides 125 for ease of insertion. In those slots where a base power unit is not provided, it is generally preferred that the space be covered by slot cover 124. More particularly, a significant part of the present invention includes backplane chassis 150 which sits at the back of cabinet 120. The unit is topped with removable cover 122 which may also include slot guides corresponding to those present in the bottom of housing 120. Electrical power is supplied to the unit through AC connector 128 which is also preferably provided with protective cover 129. In a preferred aspect of the power supply unrelated to the invention described herein, there is also provided a power connection interface (PCI) card 123 possessing an RS232 serial port and also being connected to various ones of the signal lines on chassis backplane 150. Although not visible in FIG. 10, base power units 110 include plug components on the back thereof which interconnect with corresponding connectors 126 on chassis backplane 150. While the present invention preferably includes a chassis backplane such as that shown in FIG. 10 it is noted that it is also possible to implement the present invention through the utilization of a wiring harness. However, this is not the preferred embodiment of the present invention.

A chart indicating the characteristics of various configurations in the present invention is shown in the table below (for a 3.5 KW base BPU):

| OUTPUT POWER | DESCRIPTION | MODULES INSTALL |
|---|---|---|
| 3.5 KW | NON-REDUNDANT (N MODE) | BPU #3 or #4 |
| 3.5 KW | REDUNDANT (N + 1 MODE) | BPU #3 and #4 |
| 7.0 KW | REDUNDANT (N + 1 MODE) | BPU #1, #2 and #3 |
| 10.5 KW | REDUNDANT (N + 1 MODE) | BPU #1, #2, #3 and #4 |

From the above comments it should be appreciated that the present invention fulfills all of the objects set forth above. In particular, it is seen that the invention provides a scalable electric power assembly which is capable of receiving a plurality of base power units so as to provide an appropriate sealability and redundancy. It is also seen that this redundancy is achieved by means of special purpose line sharing circuitry present in each base power unit which also includes means for phase switching in the event of certain failures. Accordingly, it is seen that the present invention provides an improved level of reliability and availability and flexibility for power systems, especially those supplying parallel processing computer complexes.

While the invention has been described in detail herein in accordance with certain preferred embodiments thereof, many modifications and changes therein may be effected by those skilled in the art. Accordingly, it is intended by the appended claims to cover all such modifications and changes as fall within the true spirit and scope of the invention.

The invention claimed is:

1. A scalable electric power assembly comprising:

a chassis capable of having inserted therein a plurality of base power units which may be attached thereto at a plurality of different chassis locations; and a circuit board, contained within said chassis, said circuit board having interconnections thereon which provide a signal path for sensing at a first one of said chassis locations a power condition associated with a base power unit attached at a second one of said chassis locations, with said circuit board also having interconnections thereon which provide a signal path for selectively activating a base power unit attached at a chassis location other than said second chassis location, said activating being based upon said power condition.

2. The power assembly of claim 1 in which said selective activation is also based upon the number of base power units connected to said chassis.

3. A scalable electric power unit comprising:

a plurality of base power units having three-phase power input connections and being operable to process input power in either single phase or three-phase form;

means associated with at least two base power units for detecting operability status in a different one of said base power units ; and means for interconnecting at least two of said base power units to provide a signal path, between at least two of said base power units, for selecting single or three-phase operation as determined by said operability status.

4. The power unit of claim 3 in which said interconnection means is a backplane circuit board.

5. The power unit of claim 3 in which said interconnection means is a wiring harness.

* * * * *